US008959922B2

(12) United States Patent
Colmegna et al.

(10) Patent No.: US 8,959,922 B2
(45) Date of Patent: Feb. 24, 2015

(54) FUEL NOZZLE WITH FLOWER SHAPED NOZZLE TUBE

(75) Inventors: Giacomo Colmegna, Lomazzo (IT); Ulrich Wörz, Oviedo, FL (US); Jaap Van Kampen, Roermond (NL)

(73) Assignee: Siemens Aktiengesellschaft, München (DE)

( * ) Notice: Subject to any disclaimer, the term of this patent is extended or adjusted under 35 U.S.C. 154(b) by 889 days.

(21) Appl. No.: 13/121,461

(22) PCT Filed: Sep. 25, 2009

(86) PCT No.: PCT/EP2009/062460

§ 371 (c)(1),
(2), (4) Date: Jun. 9, 2011

(87) PCT Pub. No.: WO2010/034819

PCT Pub. Date: Apr. 1, 2010

(65) Prior Publication Data

US 2011/0232289 A1 Sep. 29, 2011

(30) Foreign Application Priority Data

Sep. 29, 2008 (EP) ..... 08017127
Sep. 29, 2008 (EP) ..... 08017128

(51) Int. Cl.
*F23D 14/22* (2006.01)
*F23D 14/58* (2006.01)
*F23R 3/28* (2006.01)

(52) U.S. Cl.
CPC ..... *F23D 14/22* (2013.01); *F23D 14/58* (2013.01); *F23R 3/28* (2013.01)
USPC ..... 60/737; 60/740

(58) Field of Classification Search
CPC ..... F23D 14/22; F23D 14/58; F23R 3/28
USPC ..... 60/737, 748, 740, 761
See application file for complete search history.

(56) References Cited

U.S. PATENT DOCUMENTS

| | | | | |
|---|---|---|---|---|
| 2,121,948 | A | 6/1938 | Borland | |
| 3,866,413 | A * | 2/1975 | Sturgess | 60/742 |
| 3,901,445 | A | 8/1975 | Chang | |
| 5,048,433 | A * | 9/1991 | Green et al. | 110/260 |
| 5,235,813 | A * | 8/1993 | McVey et al. | 60/737 |
| 5,315,815 | A * | 5/1994 | McVey et al. | 60/776 |
| 5,558,515 | A * | 9/1996 | Althaus et al. | 431/284 |
| 5,573,395 | A * | 11/1996 | Althaus et al. | 431/278 |
| 5,622,054 | A * | 4/1997 | Tingle | 60/737 |
| 6,122,916 | A * | 9/2000 | Amos et al. | 60/747 |

(Continued)

FOREIGN PATENT DOCUMENTS

| | | |
|---|---|---|
| EP | 1391653 A2 | 2/2004 |
| EP | 1 645 807 A1 | 4/2006 |

(Continued)

*Primary Examiner* — Phutthiwat Wongwian
*Assistant Examiner* — Carlos A Rivera

(57) ABSTRACT

A fuel nozzle including a nozzle tube and a nozzle outlet opening is provided. The nozzle tube is connected to a fuel feed line for feeding a fuel to the nozzle tube, wherein the fuel is fed from the nozzle outlet opening to an annular air stream surrounding the fuel nozzle, wherein a first nozzle tube section that extends up to the nozzle outlet opening is designed in a floral pattern in such a way that the fuel may be fed substantially coaxially into the air stream.

10 Claims, 3 Drawing Sheets

(56) References Cited

U.S. PATENT DOCUMENTS

| | | | | |
|---|---|---|---|---|
| 6,189,320 | B1 * | 2/2001 | Poeschl et al. | 60/737 |
| 7,032,386 | B2 * | 4/2006 | Mandai et al. | 60/757 |
| 8,511,087 | B2 * | 8/2013 | Fox et al. | 60/737 |
| 2003/0058737 | A1 * | 3/2003 | Berry et al. | 366/340 |
| 2004/0146821 | A1 | 7/2004 | Joshi | |
| 2005/0097889 | A1 * | 5/2005 | Pilatis et al. | 60/743 |
| 2006/0156734 | A1 * | 7/2006 | Bland | 60/776 |
| 2008/0078180 | A1 | 4/2008 | Durbin et al. | |

FOREIGN PATENT DOCUMENTS

| | | | |
|---|---|---|---|
| EP | 1 892 472 | A1 | 2/2008 |
| GB | 173901 | A | 1/1922 |
| JP | H07012758 | A | 1/1995 |
| JP | 8145361 | A | 6/1996 |
| JP | H08145361 | A | 6/1996 |
| JP | H09222228 | A | 8/1997 |
| JP | H11062622 | A | 3/1999 |
| WO | WO 99/06767 | A1 | 2/1999 |

* cited by examiner

FUEL NOZZLE WITH FLOWER SHAPED NOZZLE TUBE

CROSS REFERENCE TO RELATED APPLICATIONS

This application is the US National Stage of International Application No. PCT/EP2009/062460, filed Sep. 25, 2009 and claims the benefit thereof. The International Application claims the benefits of European Patent applications No. 08017127.5 EP filed Sep. 29, 2008 and No. 08017128.3 EP filed Sep. 29, 2008. All of the applications are incorporated by reference herein in their entirety.

FIELD OF INVENTION

The invention relates to a fuel nozzle comprising a nozzle tube and a nozzle outlet opening, wherein the nozzle tube is connected to a fuel feed line for the purpose of feeding a fuel into the nozzle tube, wherein the fuel is injected from the nozzle outlet opening into an air flow which surrounds the fuel nozzle essentially in a ring shape, and a first nozzle tube section extending as far as the nozzle outlet opening is embodied in a flower shape and moreover in such a way that the fuel can be injected essentially coaxially into the air flow, wherein the nozzle outlet opening has a closed stigma embodied in a cone shape.

BACKGROUND OF INVENTION

The increasing cost of natural gas necessitates the continuing development of alternative fuels. One example of such is low-calorie fuel gas, also referred to in the following as synthesis gas. In principle, synthesis gas can be produced from solid, liquid or gaseous starting materials. Coal gasification, biomass gasification and coke gasification should be cited as the principal processes used in the context of synthesis gas production from solid starting materials.

In view of the ever more stringent requirements in respect of nitrogen oxide emissions, premix combustion is becoming increasingly important also for the combustion of low-calorie gases.

Premix burners typically include a premix zone in which air and fuel are mixed before the mixture is conducted into a combustion chamber. There, the mixture is combusted, generating a hot gas under increased pressure in the process. Said hot gas is directed onward to the turbine. The most important consideration in connection with the operation of premix burners is to restrict the nitrogen oxide emissions to a minimum and to avoid a flame blowback.

Synthesis gas premix burners are characterized in that synthesis gases are used as fuel therein. Compared with the traditional turbine fuels of natural gas and crude oil, which essentially consist of hydrocarbon compounds, the combustible constituents of the synthesis gases are essentially carbon monoxide and hydrogen. Depending on the gasification method and the overall system concept, the calorific value of the synthesis gas is roughly 5 to 10 times less than that of natural gas.

Due to its low calorific value fuel gas must accordingly be introduced into the combustion chambers at high volumetric flow rates. As a consequence thereof significantly larger injection cross-sections are required for burning low-calorie fuels, such as synthesis gases for example, than in the case of conventional high-calorie fuel gases. In order to achieve low NOx values it is, however, necessary to burn synthesis gas in a premix mode of operation.

Apart from the stoichiometric combustion temperature of the synthesis gas, a significant determining factor in avoiding temperature peaks and consequently in minimizing thermal nitrogen oxide formation is the quality of the mixing between synthesis gas and combustion air at the flame front. A spatially good mix of combustion air and synthesis gas is particularly difficult on account of the high volumetric flow rates of requisite synthesis gas and the correspondingly large spatial extension of the mixing region. On the other hand, not least for reasons of environmental protection and corresponding statutory guidelines on pollutant emissions, the lowest possible production of nitrogen oxide is an important requirement for combustion, in particular for combustion in the gas turbine plant of a power station. The formation of nitrogen oxides increases exponentially quickly with the flame temperature of the combustion. An inhomogeneous mixture of fuel and air results in a specific distribution of the flame temperatures in the combustion zone. In accordance with the cited exponential relationship between nitrogen oxide formation and flame temperature, the maximum temperature of such a distribution determines to a significant extent the amount of undesirable nitrogen oxides formed.

The individual fuel jets must penetrate into the mass air flow to an adequate depth in order to ensure satisfactory mixing between fuel and air. Compared to high-calorie burner gases such as natural gas, however, correspondingly larger, free injection cross-sections are necessary. The consequence of this is that the fuel jets seriously interfere with the air flow, ultimately leading to a local separation of the air flow in the wake region of the fuel jets. The backflow regions forming within the burner are undesirable and to be avoided at all costs in particular for the combustion of highly reactive synthesis gas. In the extreme case said local backflow regions lead within the mixing zone of the burner to a flame blowback into the premix zone and consequently result in damage to the burner.

The high reactivity of synthesis gas, in particular when there is a high percentage of hydrogen, also increases the risk of a flame blowback.

Furthermore, the larger injection cross-sections that are necessary for the synthesis gas generally lead to poor premixing of air and synthesis gas, thereby resulting in precisely said undesirable high NOx values.

In addition, drops in pressure frequently occur during the injection as a result of the high volumetric flow rate.

The mixing of synthesis gas with air is accomplished for example by means of swirling elements, such as described e.g. in EP 1 645 807 A1, or by means of an injection of the gas transversely with respect to the air flow. However, these techniques lead to a significant undesirable drop in pressure and can create undesirable wake regions which result in flame blowback.

SUMMARY OF INVENTION

Proceeding on the basis of these problems, the object of the invention is to disclose a fuel nozzle, in particular for the purpose of feeding synthesis gas, which leads to lower nitrogen oxide formation during combustion.

This object is achieved by the disclosure of a fuel nozzle comprising a nozzle tube and a nozzle outlet opening, wherein the nozzle tube is connected to a fuel feed line for the purpose of feeding a fuel into the nozzle tube, wherein the fuel is injected from the nozzle outlet opening into an air flow which surrounds the fuel nozzle essentially in a ring shape, and a first nozzle tube section extending as far as the nozzle outlet opening is embodied in a flower shape and moreover in such a way that the fuel can be injected essentially coaxially into the air flow, wherein the nozzle outlet opening has a closed stigma embodied in a cone shape.

The invention is based on the fact that large injection cross-sections must be provided in particular for large volumetric flow rates for fuel such as synthesis gas for example, this being associated with high drops in pressure. In addition, however, achieving good NOx values is contingent in particular on thorough mixing in the premix mode. However, the swirling elements used in the prior art and the injection of the fuel flow transversely with respect to the air flow lead to a considerable undesired drop in pressure which in turn leads to poor NOx values.

In this case the invention proceeds on the basis of the knowledge that an increase in the size of the contact area between synthesis gas flow and air flow produces a substantial improvement in the mixing process. This effect is crucial in particular when the fuel flow and the air flow have different flow velocities. This is brought about by the embodiment of the first nozzle tube section in the shape of a flower. Furthermore, the flower-shaped embodiment of the first nozzle tube section causes a second flow field, i.e. desired calculable turbulations, to faun at the profile trailing edges, which in turn improves the thoroughness of the mixing. This, too, is advantageous in particular when the fuel flow and the air flow have different flow velocities. The inventive flower-shaped embodiment of the first nozzle tube section furthermore enables a coaxial injection of the fuel into the air flow. By this means undesirably high drops in pressure are avoided. This permits the nozzle to be operated in the premix mode, even with high volumetric flow rates of fuel, as is the case e.g. with synthesis gas.

According to the invention the nozzle outlet opening of the fuel nozzle now has a closed stigma embodied in a cone shape. The stigma, which is arranged symmetrically around the center of the nozzle outlet opening embodied as a flower, causes a forced, thorough, end-to-end mixing of the fuel and the air over the entire area. This is of advantage primarily for the fuel that has been guided through the central region of the nozzle outlet opening. As a result of the embodiment of the nozzle outlet opening with a stigma the contact area between fuel and air is effectively increased further, having a positive effect on the mixing. Nonetheless, a coaxial injection of the fuel into the air flow continues to be possible, as a result of which only a negligible drop in pressure occurs in spite of the improved mixing.

Preferably the stigma tapers to a point in the flow direction.

Preferably the stigma is embodied in a double-cone shape. This enables boundary layer separations to be avoided as well as reducing the risk of flame blowback due to backflow regions.

In a preferred embodiment the stigma has grooves. Said grooves are incorporated on the stigma so as to correspond with the individual petals or else so as to correspond with the profile trailing edges. Said grooves essentially serve to create a smooth passage for the fuel, i.e. the fuel is discharged from the fuel nozzle without undesirable and incalculable turbulations. Boundary layer separations can therefore be avoided and the risk of flame blowback due to backflow regions reduced.

The grooves are advantageously aligned in a straight line in the flow direction and/or are wound. By this means a spin can be impressed on the air flow or fuel flow during the injection.

Preferably the first nozzle tube section tapers in the flow direction. In this way an increase in the flow velocity of the fuel is achieved.

In an alternative nozzle tube with open stigma the flower shape of the first nozzle tube section is embodied in a saw-tooth-like shape. The sawteeth cause calculable turbulations to form in the flow field, resulting in a better mixing of the fuel with the air flow. Since a coaxial injection nonetheless continues to be ensured, there is no increase in pressure drop with this embodiment of the fuel nozzle.

In this case a second nozzle tube section can be present to which the first nozzle tube section is adjoined in the flow direction, the second nozzle tube section tapering in the flow direction. This enables a further increase in the flow velocity of the fuel to be achieved.

The sawtooth-like first nozzle tube section adjoins the second nozzle tube section in the horizontal direction. In this case the sawtooth-like first nozzle tube section adjoins the second nozzle tube section which is slanted relative to the horizon. The flow velocity of the fuel is increased as a result.

The stigma is preferably connected to a tube running essentially coaxially with respect to the nozzle tube for the purpose of feeding high-calorie fuel and has at least one tangential and/or axial inlet opening.

In this case the arrangement, number and diameter of the inlet openings can vary depending on the embodiment of the burner. Since the feed for high-calorie fuel is disposed inside the synthesis gas feed (feed for high-calorie fuel is encircled by the synthesis gas feed in the manner of a ring), said inlet openings are preferably tangential and axial inlet openings, i.e. drilled holes.

It should be noted here that both the inlet openings for high-calorie fuel and the feed itself only require a small diameter, since the volumetric flow rate of the high-calorie fuel is significantly less than that of the synthesis gas. This is a contributory factor helping to ensure the feed for high-calorie fuel causes no or only minor disturbance in the air flow during synthesis gas operation.

In a preferred embodiment the at least one tangential inlet opening is arranged at the bridge between two petals of the flower-shaped synthesis gas injector. In this way it is ensured that the injection direction of e.g. the natural gas is essentially transverse with respect to the air flow. This corresponds to the preferred injection direction of a conventional premixed natural gas burner. Thorough mixing of the natural gas with the air flow is thus ensured, enabling low NOx values to be achieved. In accordance with the regulations, said low NOx values must also be guaranteed in a synthesis gas burner when the latter is operated with high-calorie fuel such as natural gas, even if said natural gas merely constitutes a "backup" function.

In a preferred embodiment the fuel nozzle is present in a burner. This is in particular a synthesis gas burner which is operated in a premix mode. In this case the burner can be configured as a two-fuel or multifuel burner which can additionally be operated with e.g. natural gas in the premix mode. Advantageously the burner is present in a gas turbine.

BRIEF DESCRIPTION OF THE DRAWINGS

Further features, advantages and details of the invention will now be described in more detail with reference to the simplified, not-to-scale figures of the drawings, in which.

Like parts are labeled with the same reference signs in all the figures.

DETAILED DESCRIPTION OF INVENTION

The high cost of natural gas is causing the current development of gas turbines to be driven in the direction of alternative fuels such as synthesis gas, for example. In principle, synthesis gas can be produced from solid, liquid or gaseous starting materials. Coal gasification should be cited as the principal method for producing synthesis gas from solid starting materials. With this process, coal is converted in a mix consisting of partial oxidation and gasification with water vapor into a mixture of CO and hydrogen. Basically, the use of other solid materials such as e.g. biomass and coke should also be mentioned in addition to coal. Different crude oil distillates can be used as liquid starting materials for synthesis gas, while natural gas should be cited as the most important gaseous starting material. In this context it should, however, be noted that the low calorific value in the case of synthesis gas means that significantly higher volumetric flows must be fed to the combustion chamber for combustion than is the case with e.g. natural gas. A consequence of this is that large injection cross-sections must be provided for the volumetric flow of the synthesis gas. However, these lead to a poor premixing of air and synthesis gas, resulting in undesirable high NOx values. Furthermore, drops in pressure frequently occur during the injection due to the high volumetric flow rate.

Swirling elements are used or the synthesis gas is injected transversely with respect to the air flow in order to achieve thorough mixing. This results in a significant undesired drop in pressure, however. Backflow regions can also form, leading to a flame blowback. This is now avoided with the aid of the invention.

Figure 1:
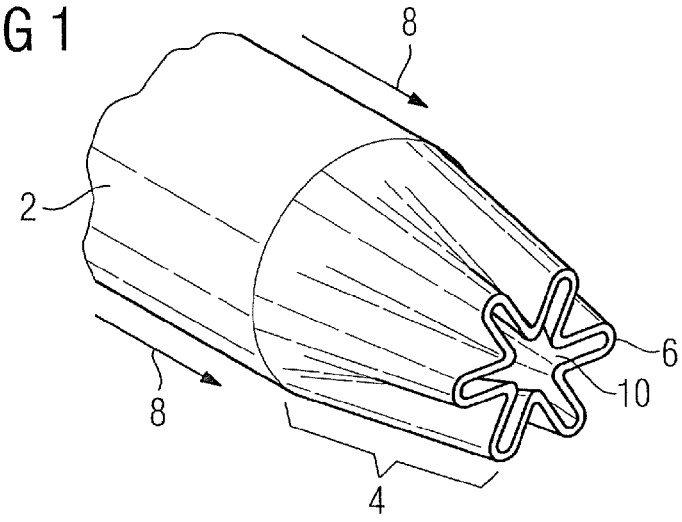
FIG. 1 shows a fuel nozzle.

FIG. 1 shows a fuel nozzle. This has a nozzle tube 2 and a nozzle outlet opening 10. In this case the nozzle tube 2 is connected to a fuel feed line (not shown) which supplies fuel to the nozzle tube 2. The fuel is injected from the nozzle outlet opening 10 into an air flow 8 which surrounds the fuel nozzle in a ring shape. The first nozzle tube section 4 extending as far as the nozzle outlet opening 10 is embodied in a flower shape 6 and moreover in such a way that an essentially coaxial injection of the fuel into the air flow 4 can be realized. In this case the synthesis gas is routed within the nozzle tube 2.

Figure 2:
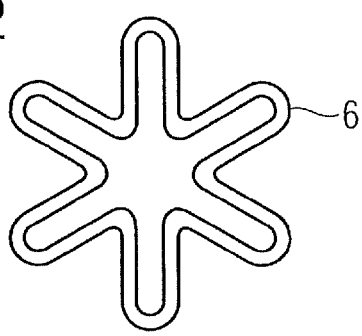
FIG. 2 shows a cross-section through the fuel nozzle.

FIG. 2 shows a cross-section through such a nozzle outlet opening 10 with six individual petals. In this case the number of petals is dependent chiefly on the individual burner types or gas turbine types and can vary. By virtue of their inventive flower-shaped embodiment 6 the nozzle tube section 4 and the nozzle outlet opening 10 establish a greater contact area between synthesis gas flow and air flow 8, thereby achieving an improved mixing between synthesis gas and air flow 8 without an increase in the pressure drop. This embodiment is particularly advantageous when the air flow 8 and the synthesis gas flow have different flow velocities. Furthermore, said flower-shaped embodiment 6 has the significant advantage that a second flow field forms, in particular at the profile trailing edges of the individual petals. Eddy structures are formed here. This also makes a significant contribution toward improving the mixing, in particular when there is considerable difference in the flow velocities of the synthesis gas and the air flow 8.

Figure 3:
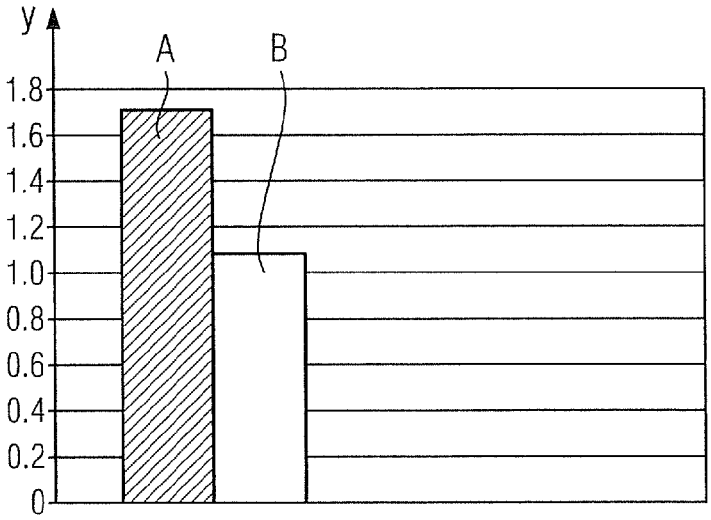
FIG. 3 is a diagram illustrating the degree of mixing.

FIG. 3 shows by way of example in the form of a diagram the improved intermixing provided by a fuel nozzle embodied in the shape of a flower, indicated here in FIG. 3 by b, compared to a fuel nozzle, in this case, for example, a ring-shaped, tapering nozzle tube according to the prior art (indicated by a in FIG. 3). In this representation the degree of non-mixing is indicated on the y-axis. The flower-shaped fuel nozzle exhibits a higher degree of mixing, though with a lower drop in pressure owing to the coaxial injection.

Figure 4:
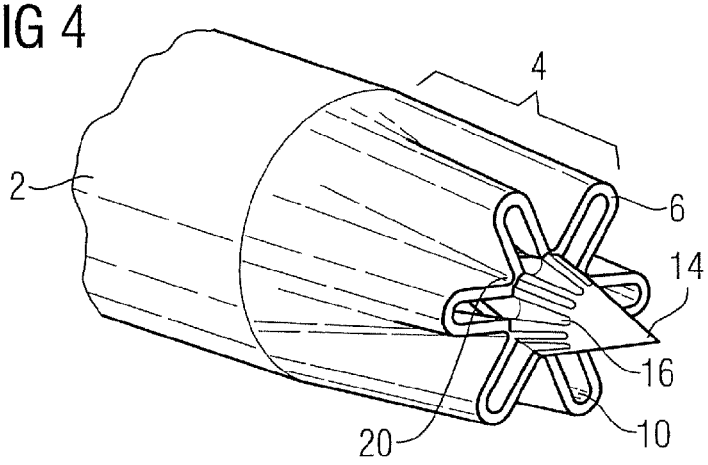
FIG. 4 shows a fuel nozzle according to the invention with stigma.

FIG. 4 shows an embodiment of a fuel nozzle according to the invention. This has a conical stigma 14 arranged centrally at the flower-shaped nozzle outlet opening 10. In this case the stigma 14 can be embodied as a single cone or double cone. This has the advantage that a smooth transition of the two flows into each other is ensured. Furthermore, this embodiment prevents a boundary layer separation or the formation of backflow regions which can provoke a flame blowback.

Grooves 16 can advantageously be incorporated in the conical stigma 14. These are advantageously incorporated on the one hand in their radial extension and alignment so as to correspond with the individual petals, in other words the groove 16 and the petals are located opposite one another. In this way a smooth exit area is realized for the synthesis gas. On the other hand further grooves 16 are incorporated which lie opposite the profile trailing edges 20 and essentially correspond with these in their radial width. These produce a smooth exit area for the air flow 8. The grooves 16 can be aligned in a straight line in the flow direction and/or have a wound configuration in order thus to achieve a turbulation of the air and/or of the fuel.

By means of the embodiment of a stigma 14 the mixing in the center of the flower-shaped 6 fuel nozzle (i.e. around the injection axes) is therefore improved. With the aid of the stigma 14 a mixing of the synthesis gas flow with the air flow 8 is consequently achieved also in the center of the flower, with the contact area between synthesis gas flow and air flow 8 again being increased in size. This allows thorough, end-to-end mixing over the entire area. Owing to the coaxial injection, however, the drop in pressure is small in spite of the extensive and consequently very good mixing.

Figure 5:
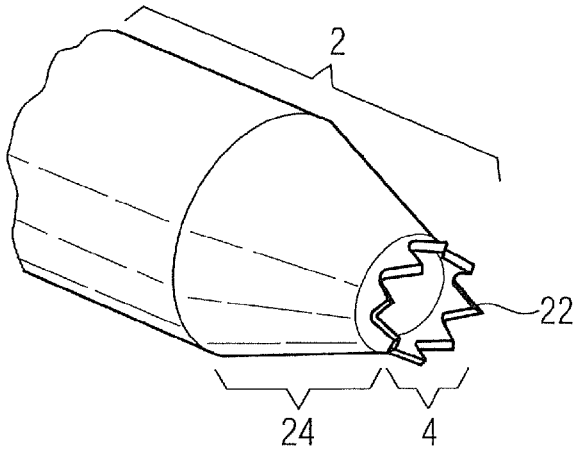
FIG. 5 shows an alternative fuel nozzle with horizontal sawteeth.
Figure 6:
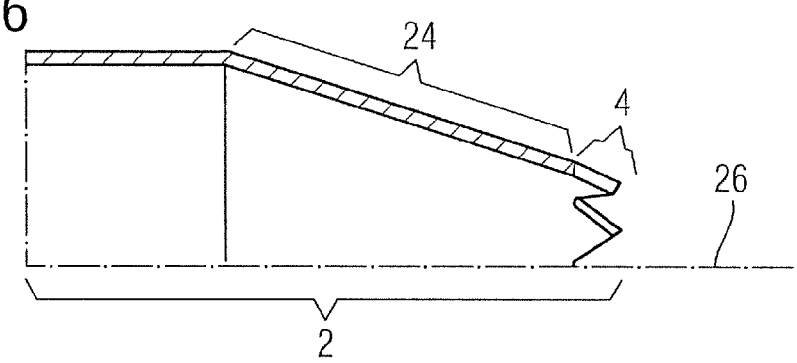
FIG. 6 shows an alternative fuel nozzle with slanted sawteeth.

FIG. 5 shows an alternative fuel nozzle in which the flower shape 8 has petals tapering to a point, i.e. is embodied essentially as sawtooth-like. In this case said sawteeth 22 are arranged at a first tube section 4. Said first tube section 4 can in this case have a constant tube diameter in the flow direction (i.e. the sawteeth 22 are essentially horizontal) or else be tapered in the flow direction (i.e. the sawteeth 22 are slanted relative to the horizontal line 26, FIG. 6). A second tube section 24 to which the first tube section 4 is adjoined in the flow direction can be tapered in order to provide better injection in the flow direction. The embodiment of the fuel nozzle with sawteeth 22 is intended to generate desired turbulations in the flow field, which in turn improves the mixing between synthesis gas and air flow 8.

Here too, however, in spite of the extensive and consequently very thorough mixing over the whole area, the drop in pressure is small because of the coaxial injection.

Figure 7:
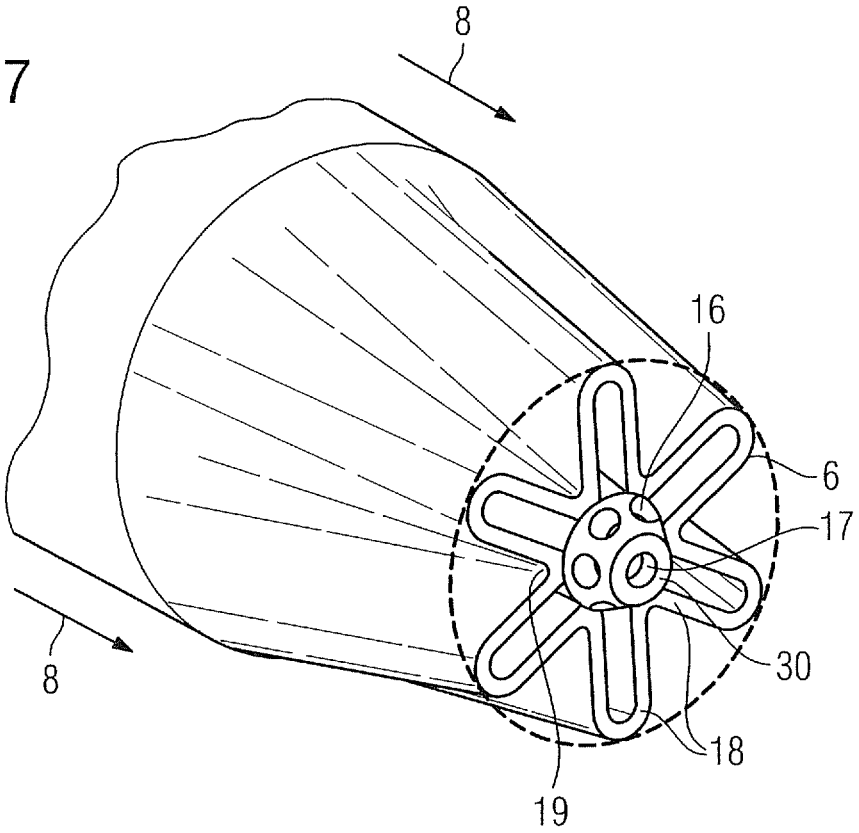
FIG. 7 shows a magnified view of the inventive fuel feed with a second-fuel feed, and FIG. 8 schematically shows a second-fuel feed (natural gas feed).

FIG. 7 shows an embodiment variant of the inventive fuel nozzle with second-fuel feed. Since the synthesis gas inlet openings are required to ensure a large volumetric flow rate, the fuel nozzle is embodied in a flower shape 6 in respect of the synthesis gas according to the invention.

Tangential natural gas inlet openings 16 are placed between two petals 18. The point of contact or line of contact between two petals 18 is in this case referred to in the following as a flower bridge 19. This means that the natural gas flow 33 can be injected directly into the air flow 8 without a petal 18 being situated therebetween. This ensures that the natural gas is injected essentially transversely with respect to the air flow 8. In this case FIG. 7 has six tangential natural gas inlet openings 16 and one axial natural gas inlet opening 17. Both the number and the arrangement can vary depending on burner and gas turbine. In this case the natural gas inlet openings 16,17 are essentially round and can be produced by means of drilling.

The synthesis gas feed and its flower-shaped 6 synthesis gas inlet opening as well as the natural gas feed 30 with the natural gas inlet openings 16,17 are in this case embodied in such a way that a drop in pressure below 25 dp/p is achieved with the same heat input in terms of synthesis gas and natural gas.

Figure 8:
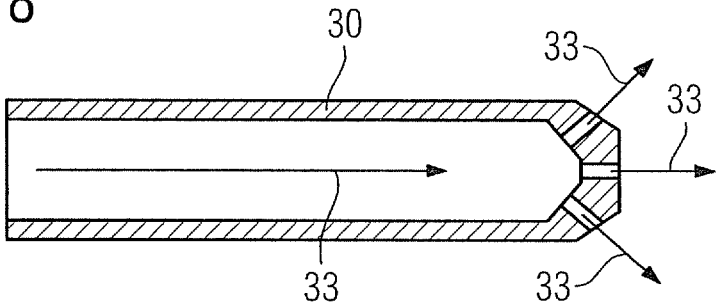

FIG. 8 schematically shows the natural gas feed 30. Since the volumetric flow rate of the natural gas is considerably less than that for synthesis gas, the diameter of the natural gas feed 30 is considerably less than that of the synthesis gas feed. In order to switch from synthesis gas to natural gas operation or vice versa it is simply necessary to interrupt the synthesis gas feed or, as the case may be, natural gas feed 30. This can be achieved without changes to the hardware.

Any other high-calorie burner fuel, fuel oil for example, can also be used instead of natural gas. Similarly, the flower shape 6 of the synthesis gas inlet opening is merely an example: other shapes of synthesis gas inlet opening are equally conceivable.

Good mixing between volume-rich synthesis gas and air is made possible by means of the fuel nozzle according to the invention. The drop in pressure is nonetheless small owing to the coaxial injection. Drops in pressure resulting, for example, from the installation of swirling elements alone are avoided thereby. This assists operation in the premix mode, which in turn has a positive impact on the NOx values.

By means of the fuel nozzle according to the invention it is also possible to integrate a so-called backup fuel line, since it is intended that synthesis gas burners should in each case be capable of operating not just with one fuel, but as far as possible with different fuels, oil, natural gas and/or coal gas for example, alternatively or even in combination in order to increase the reliability of supply and flexibility in operation. By means of this invention it is possible to use the same nozzle for natural gas (or diluted natural gas) or synthesis gas. This simplifies the design of the burner and reduces component parts considerably.

The fuel nozzle presented here is not, however, limited only to operation with synthesis gas. Rather, it can be advantageously operated with any fuel. This advantage should be emphasized particularly in the case of a volume-rich fuel flow. The fuel nozzle according to the invention is particularly suitable in the premix mode of operation.

The invention claimed is:

1. A fuel nozzle for an essentially coaxial injection of a fuel into an air flow, comprising:
- a nozzle tube;
- a first nozzle tube section; and
- a nozzle outlet opening,
- wherein the nozzle tube is connected to a fuel feed line in order to feed a fuel into the nozzle tube,
- wherein the fuel is injected from the nozzle outlet opening into an air flow which surrounds the fuel nozzle essentially in a shape of a ring,
- wherein the first nozzle tube section extends as far as the nozzle outlet opening,
- wherein the first nozzle tube section is embodied in a flower shape, and
- wherein the nozzle outlet opening includes a closed stigma embodied in a double-cone shape.

2. The fuel nozzle as claimed in claim 1, wherein the closed stigma includes a plurality of grooves.

3. The fuel nozzle as claimed in claim 2, wherein the plurality of grooves are aligned in a straight line in the flow direction and/or are wound.

4. The fuel nozzle as claimed in claim 1, wherein the first nozzle tube section tapers in the flow direction.

5. A burner, comprising:
- a fuel nozzle, comprising:
  - a nozzle tube,
  - a first nozzle tube section, and
  - a nozzle outlet opening,
- wherein the nozzle tube is connected to a fuel feed line in order to feed a fuel into the nozzle tube,
- wherein the fuel is injected from the nozzle outlet opening into an air flow which surrounds the fuel nozzle essentially in a shape of a ring,
- wherein the first nozzle tube section extends as far as the nozzle outlet opening,
- wherein the first nozzle tube section is embodied in a flower shape, and
- wherein the nozzle outlet opening includes a closed stigma embodied in a double-cone shape.

6. The burner as claimed in claim 5, wherein the closed stigma includes a plurality of grooves.

7. The burner as claimed in claim 6, wherein the plurality of grooves are aligned in a straight line in the flow direction and/or are wound.

8. The burner as claimed in claim 5, wherein the first nozzle tube section tapers in the flow direction.

9. A gas turbine, comprising:
- a burner, comprising:
  - a fuel nozzle, comprising:
    - a nozzle tube,
    - a first nozzle tube section, and
    - a nozzle outlet opening,
- wherein the nozzle tube is connected to a fuel feed line in order to feed a fuel into the nozzle tube,
- wherein the fuel is injected from the nozzle outlet opening into an air flow which surrounds the fuel nozzle essentially in a shape of a ring,
- wherein the first nozzle tube section extends as far as the nozzle outlet opening,
- wherein the first nozzle tube section is embodied in a flower shape, and
- wherein the nozzle outlet opening includes a closed stigma embodied in a double-cone shape.

10. The gas turbine as claimed in claim 9, wherein the closed stigma includes a plurality of grooves.

* * * * *